US006173469B1

(12) United States Patent
Laymon

(10) Patent No.: US 6,173,469 B1
(45) Date of Patent: Jan. 16, 2001

(54) URETHANE SPRING FOR USE IN A PIPELINE PIG

(76) Inventor: Dwane O. Laymon, P.O. Box 3489, Tulsa, OK (US) 74109-3489

( * ) Notice: Under 35 U.S.C. 154(b), the term of this patent shall be extended for 0 days.

(21) Appl. No.: 09/347,567

(22) Filed: Jul. 6, 1999

(51) Int. Cl.[7] ..... B08B 9/055
(52) U.S. Cl. ..... 15/104.061; 15/104.19
(58) Field of Search ..... 15/104.05, 104.061, 15/104.17, 104.18, 104.19

(56) References Cited

U.S. PATENT DOCUMENTS

| | | | |
|---|---|---|---|
| 2,957,189 | 10/1960 | Nelson et al. | 15/104.061 |
| 3,576,043 | 4/1971 | Zongker | 15/104.061 |
| 3,604,041 | 9/1971 | Ver Nooy | 15/104.061 |
| 5,052,652 | 10/1991 | Sevilleia et al. | 248/634 |
| 5,208,936 | 5/1993 | Campbell | 15/104.061 |
| 5,280,890 | 1/1994 | Wydra | 267/220 |
| 5,326,083 | 7/1994 | Wydra et al. | 267/139 |

FOREIGN PATENT DOCUMENTS

| | | |
|---|---|---|
| 2229247 | 9/1990 | (GB) . |
| 420356 | 8/1974 | (SU) . |
| 1574289 | 6/1990 | (SU) . |

*Primary Examiner*—Mark Spisich
(74) *Attorney, Agent, or Firm*—William S Dorman

(57) ABSTRACT

A cleaning device of the type for removing dirt, scale and extraneous material from the inner wall of a pipeline which comprises a body adapted to be moved longitudinally through the pipeline, a plurality of scraper elements mounted on the body for resiliently engaging the inner wall of the pipeline as the body is moved along the pipeline and at least one cup mounted on the body for sealably engaging the pipeline wall so that the body may be propelled through the pipeline by fluid pressure behind the cup, the improvement which comprises a polyurethane spring mounted between the body and each of the scraping elements for resiliently urging the scraping elements against the inner wall of the pipeline, the polyurethane spring comprising an elongated base member for attachment of the spring to the body, an outer side member disposed in spaced parallel relation with the inner base member and a plurality of cross members extending outwardly and rearwardly from the inner base member to and connecting with the outer side member, the cross members being essentially parallel to each other, the scraping elements being mounted on the outer side member and being resiliently urged against the inner wall of the pipeline by the polyurethane spring, the pressure of the spring against the outer side member being such as to tend to cause the outer side member to move rearwardly and inwardly, while the cross members cant in a rearward direction.

4 Claims, 5 Drawing Sheets

URETHANE SPRING FOR USE IN A PIPELINE PIG

BACKGROUND OF THE INVENTION

1. Field of the Invention

The present invention relates to a device for cleaning a pipeline or other conduit by removing dirt, scale, and/or extraneous matter from the inner wall of the pipeline. More particularly, the present invention relates to a polyurethane spring which is used to support the cleaning device against the inner wall of the pipeline.

2. Prior Art

Conventional devices of the type used to clean the inner wall of a pipeline generally include a body adapted to be moved longitudinally through the pipeline and a series of scraper elements mounted on the body for engaging the inner wall of the pipeline as the body is so moved. One or more cups may also be mounted on the body for sealably engaging the pipeline wall so that the body may be propelled through the pipeline by means of fluid pressure behind the cups.

The scraping elements may comprise brushes with stiff bristles, blades disposed at an angle with respect to the axis of the body, or a combination thereof. In any case the scraping elements are tightly urged against the pipeline wall and are arranged about the body so as to scrape the entire circumference of the pipeline wall during a single pass of the device. In the past, the scraping elements such as the brushes with stiff bristles, have been mounted on the body by means of leaf springs which urge the brushes against the inner wall of the pipeline. The present invention involves the substitution of a polyurethane spring for the leaf spring heretofore employed.

A patentability search was conducted on the present invention and the following references were uncovered in the search:

| Patent No. | Inventor | Dated |
|---|---|---|
| 2,957,189 | Nelson | Oct. 25, 1960 |
| 3,576,043 | Zongker | Apr. 27, 1971 |
| 3,604,041 | Ver Nooy | Sept. 14, 1971 |
| 5,052,652 | Sevilleja et al | Oct. 1, 1991 |
| 5,208,936 | Campbell | May 11, 1993 |
| 5,280,890 | Wydra | Jan. 25, 1994 |
| 5,326,083 | Wydra et al | Jul. 5, 1994 |
| UK2,229,247 A | Kershaw | Sept. 19, 1990 |
| RU420,356 | Petr Prod | Aug. 26, 1974 |
| RU1574289-A | Oil Product | June 30, 1990 |

Russian Patent No. 420,356, describes a hollow shaft and cleaning elements forming a hinged parallelogram. A cleaning brush is mounted on a parallelogram type structure which is metallic. The assembly is urged against the side of the pipe by means of an arrangement involving a central shaft, springs, etc.

Sevilleja et al, U.S. Pat. No. 5,052,652, is relevant only in that it discloses a damping device which has a rectangular prismatic shape with rubber inserts. There is nothing in this patent to suggest that the damping device could be employed in a cleaning pig to urge the cleaning devices against the pipeline wall.

Zongker U.S. Pat. No. 3,576,043, in column 3, lines 27–34, talks about cups, bumpers, and scraper ribs being made of polyurethane. However, the spring members 17 are still described as "bowed leaf springs".

Nelson U.S. Pat. No. 2,975,189 shows a parallelogram type arrangement for the cleaning brushes. Nevertheless, the cleaning brushes are still spring mounted by means of metallic springs.

Ver Nooy, U.S. Pat. No. 3,604,041, is deemed pertinent in that the base, blade and rod are described a being made of urethane. Nevertheless, the spring element 15 is still a leaf spring.

U.S. Pat. No. 5,280,890 to Wydra shows a compression spring which can be made of an elastomer which is not specifically disclosed as a polyurethane, but which is believed to be an equivalent. There is no showing that his elastometric compression spring could be used to urge the cleaning brushes of a cleaning pig against the inner wall of the pipeline.

U.S. Pat. No. 5,326,083, also issued to Wydra, shows a compression spring formed of an elastomer. The same comments hold true as with respect to the last Wydra patent discussed.

Russian Patent No. 1574289-A, shows a parallelogram type arrangement. This reference still lacks the teachings of a polyurethane spring.

UK Patent No. 2 229 247 A, shows a polyurethane disc 12 supporting a plurality of cleaning fingers 19, capable of scraping scale or wax 11 from the inside of a pipeline 10. The cleaning fingers 19 appear to be made of metal.

SUMMARY OF THE INVENTION

This invention involves a cleaning device, or cleaning pig, of the type used to engage the inner wall of a pipeline to remove rust, scale and other debris from the inner wall of the pipeline. This invention, briefly, involves the substitution of a polyurethane spring for the conventional leaf spring which has been heretofore used to urge the scraper elements, such as brushes, resiliently against the inner wall of the pipeline. More particularly, the polyurethane spring of the present invention comprises an elongated base member for attachment of the spring to the body of the cleaning pig. The spring also includes an outer side member disposed in spaced parallel relation with the inner base member and a plurality of cross members extending outwardly and rearwardly from the inner base member to and connecting with the outer side member. The cross members are essentially parallel to each other. The scraping elements, such as wire brushes, are attached to the outer side member and are resiliently urged against the inner wall of the pipeline by means of the polyurethane spring. The pressure of the spring against the outer side member is such as to cause the outer side member to move rearwardly and inwardly while the cross members cant in a rearward direction.

DETAILED DESCRIPTION OF THE PREFERRED EMBODIMENTS

Figure 1:
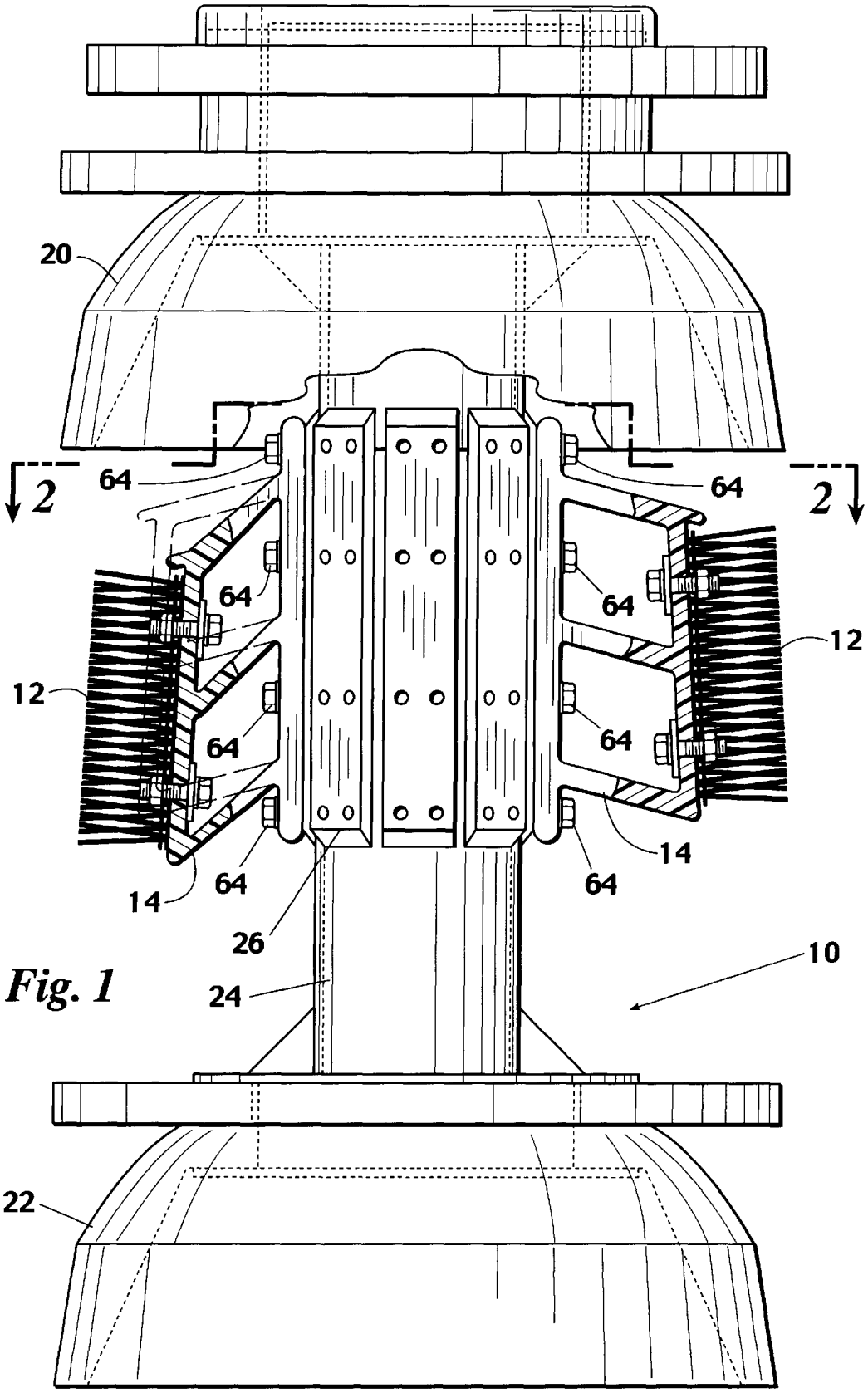
FIG. 1 is a side elevation of a pipeline pig, with some parts broken away and certain parts in section, showing features of the present invention.

Referring to the drawings in detail, FIG. 1 shows a pipeline pig 10 on which is mounted a plurality of brushes 12 supported from a polyethylene spring 14. The assembly of brush 12 and spring 14 is mounted between a forward cup 20 and a rear cup 22. A central shaft 24 runs between the two cups and connects them together. The shaft 24 also supports a plurality of lifting blocks 26 to which the polyurethane spring 14 is attached directly.

Figure 3:
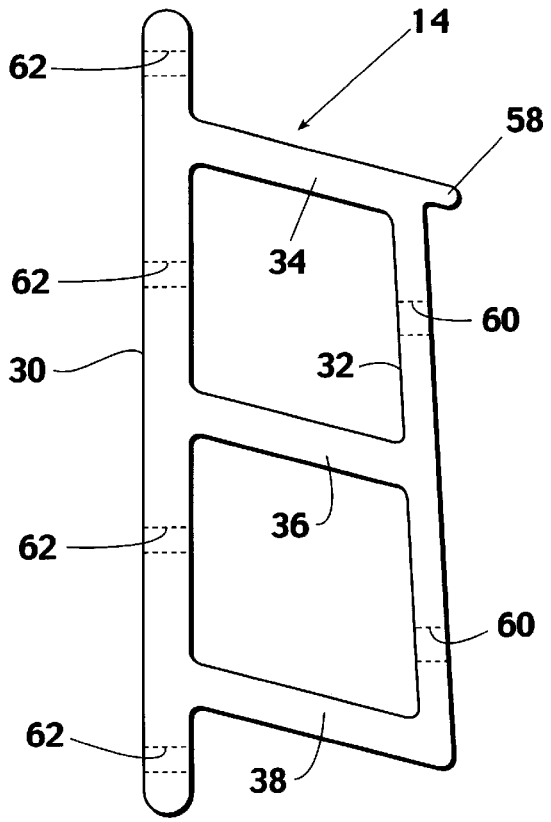
FIG. 3 is a side elevation of one of the urethane springs shown in FIG. 1.
Figure 4:
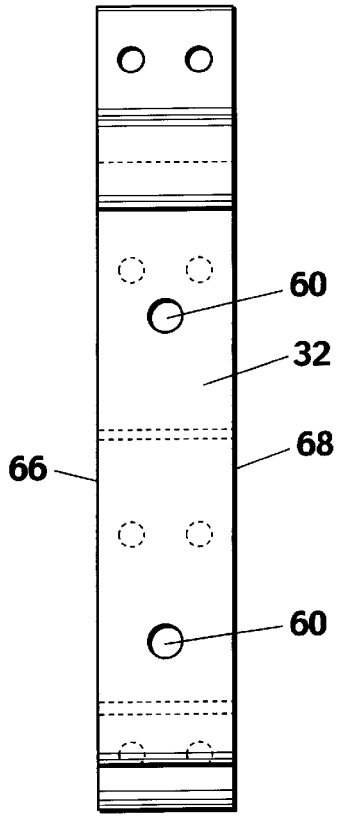
FIG. 4 is a right-hand end view taken off FIG. 3.
Figure 5:
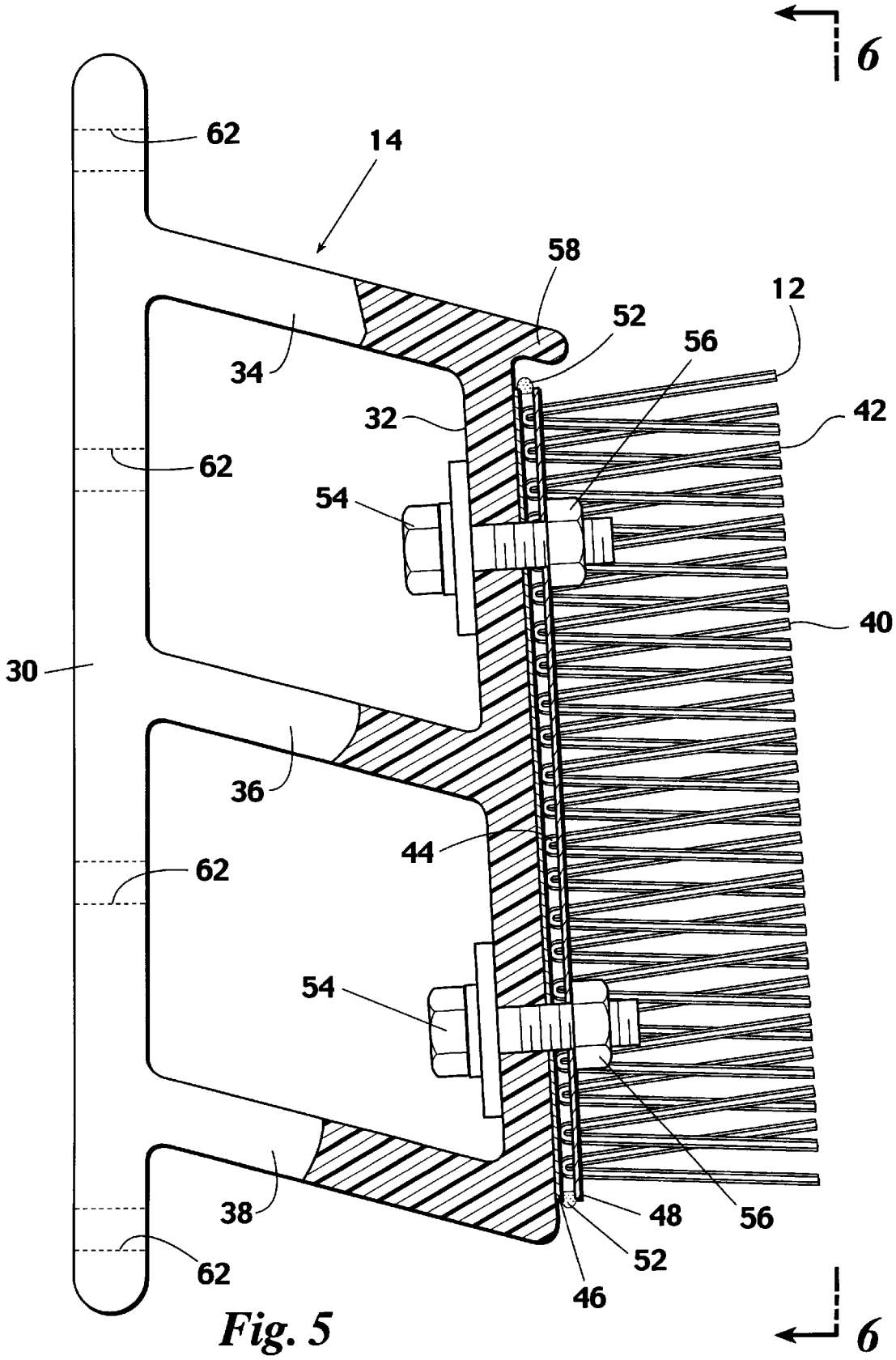
FIG. 5 is a view similar to FIG. 3, but on an enlarged scale, and showing the brush attached to the polyurethane spring.

The polyurethane spring 14, which is best shown in FIGS. 3, 4, and 5 consists of an inner base member 30, an opposite outer side member 32 which is spaced in parallel relation to the base 30 and a plurality of cross members or vanes 34, 36, and 38. When a pressure is exerted against the brush 12 and, in turn, against the spring 14, the latter will collapse as shown on the left side of FIG. 1.

Lifting blocks 26 are first secured to the shaft 24, the polyurethane springs 14 are secured to the lifting blocks by means of bolts or other suitable means and the brushes 12 are bolted to the outer member 32 of the spring 14.

Figure 6:
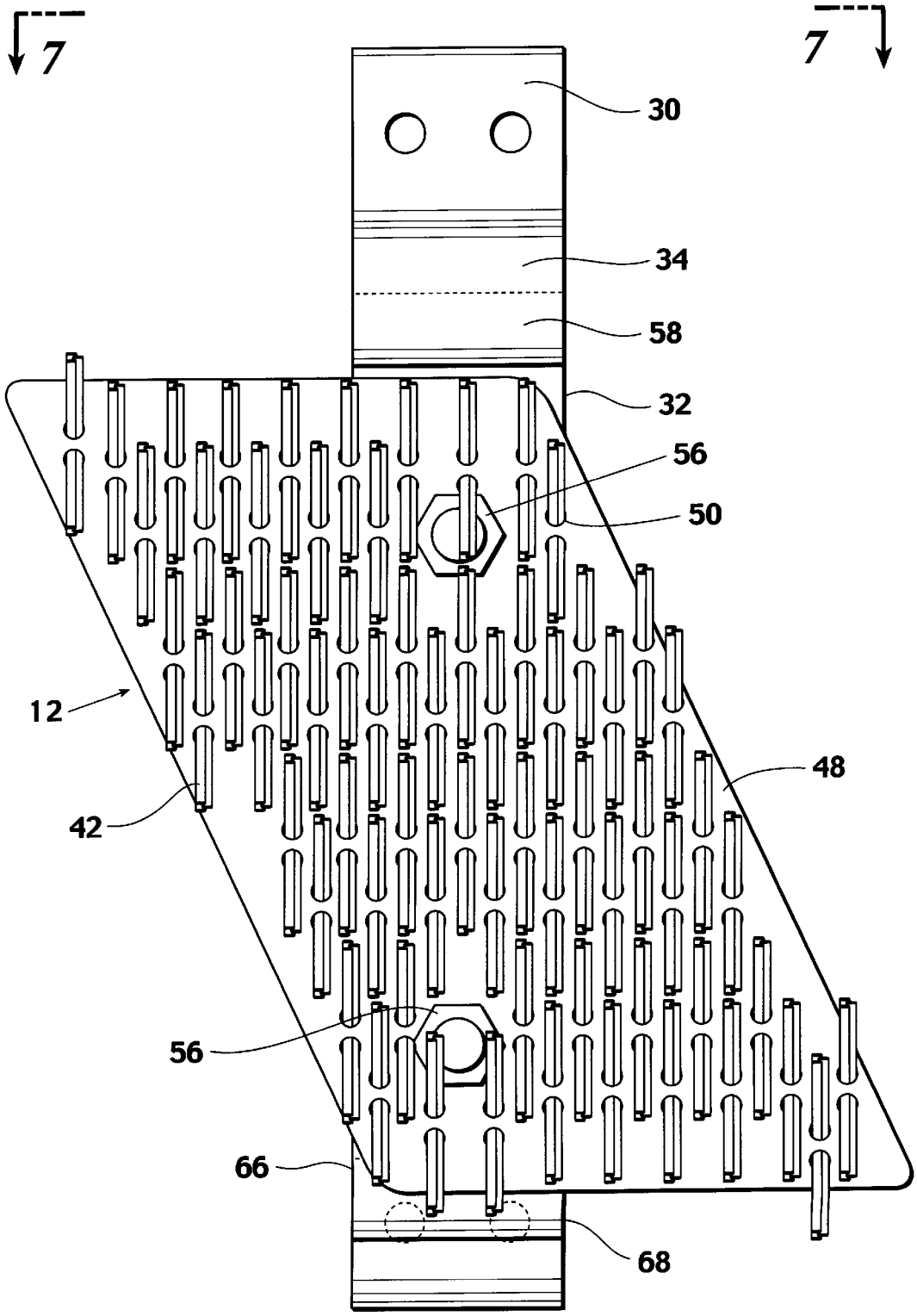
FIG. 6 is an end view of the brush and spring mount shown in FIG. 5, looking along viewing line 6—6.

Each brush 12 is formed from a plurality of wires 40 whose outer ends 42 are adapted to contact the wall of the pipeline (not shown) to scrape dirt, or other material from the inner wall of the pipeline. The inner ends 44 of the wires 40 are bend at an acute angle. The portion of the wire brush 12 which is attached to the member 32 comprises a pair of spaced metallic plates 46 and 48. The bends 44 of the wires 42 abut against the surface of the plate 46 while the plate 48 is provided with holes 50 through which the wires 40 project. The adjacent edges of the plates 46 and 48 are spot welded together around their adjacent edges, for example as at 52. When looking radially in at the assembly, the plates 46 and 48 are shaped in a form of a parallelogram as best shown in FIG. 6. A plurality of bolts 54 pass through suitable holes in the member 32 and through aligned holes in the plates 46 and 48. The outer ends of the bolts 54 are secured by means of nuts 56 as best shown in FIG. 5.

Figure 2:
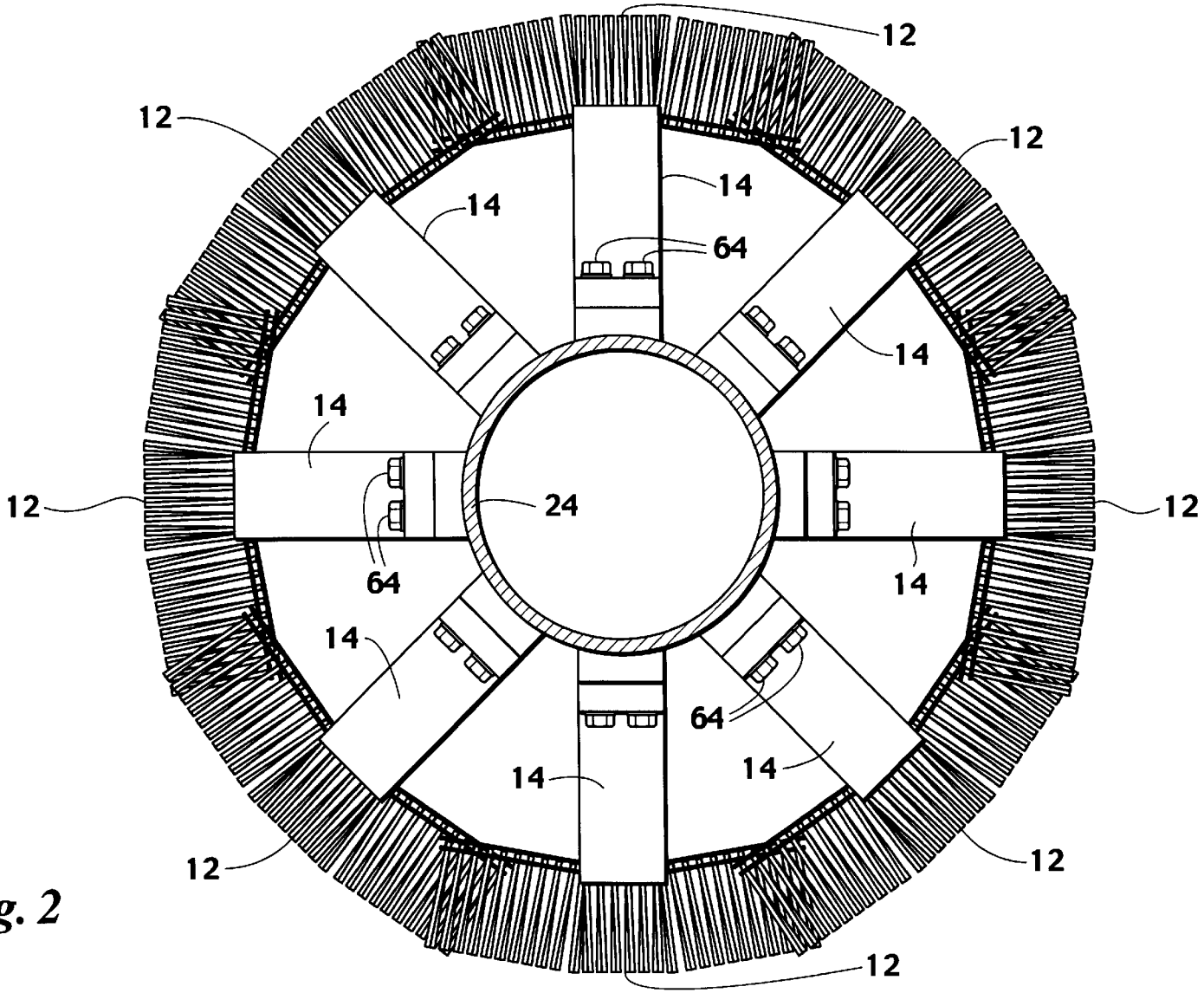
FIG. 2 is a sectional view, taken along section line 2—2 of FIG. 1.

The reason that the plates 46 and 48 are shaped in the form of a parallelogram as shown in FIG. 6 is to provide essentially complete coverage of the inner wall of the pipeline as the cleaning device moves forwardly through the pipeline. Referring again to FIG. 6, it should be understood that a plurality of polyurethane springs 14 with brushes mounted thereon would be disposed around the circumference of the body 24. Depending upon the spacing between adjacent springs and brush assembly, the lower right-hand end of the plate 48 would be disposed beneath the upper left-hand end of an adjacent plate 48 on a adjacent spring 14. This overlapping relationship is also shown in FIG. 2. For example, the spring 14 shown in the 9 o'clock position on FIG. 2 has an upper end disposed above the lower end of the spring in the 11 o'clock position. Similarly, the lower end of the 9 o'clock spring as shown in FIG. 2 is below the upper end of the spring shown in the 7 o'clock.

Turning now to consideration of FIGS. 3 and 4. The outer side member 32 is actually not parallel with the base member 30. When sufficient force is exerted against the side member 32 as a result of the brushes contacting the inner surface of the pipeline wall (not shown) the side 32 will cant around the transverse sides 34, 36, and 38 so that the side 32 approaches parallelism with the inner base member 30. The right-hand (as it appears in FIG. 3) end of the transverse member 34 is provided with a lip or overhang 58 which extends above the brush assembly 12 as shown in FIG. 5. The side 32 is provided with a pair of holes 60 which accommodate the bolts 54. For the purpose of attaching each spring 14 to its associated lifting block 26, the base member 30 is provided with a plurality of holes 62 which are adapted to receive a plurality of bolts 64 which pass through these holes 62 and into the lifting blocks 26 as best shown in FIG. 1.

Looking at FIGS. 3 and 4, the left side (as it appears in FIG. 4) of the forward member 32 is provided with a relatively flat surface 66 and the opposite side is also flat at 68.

Figure 7:
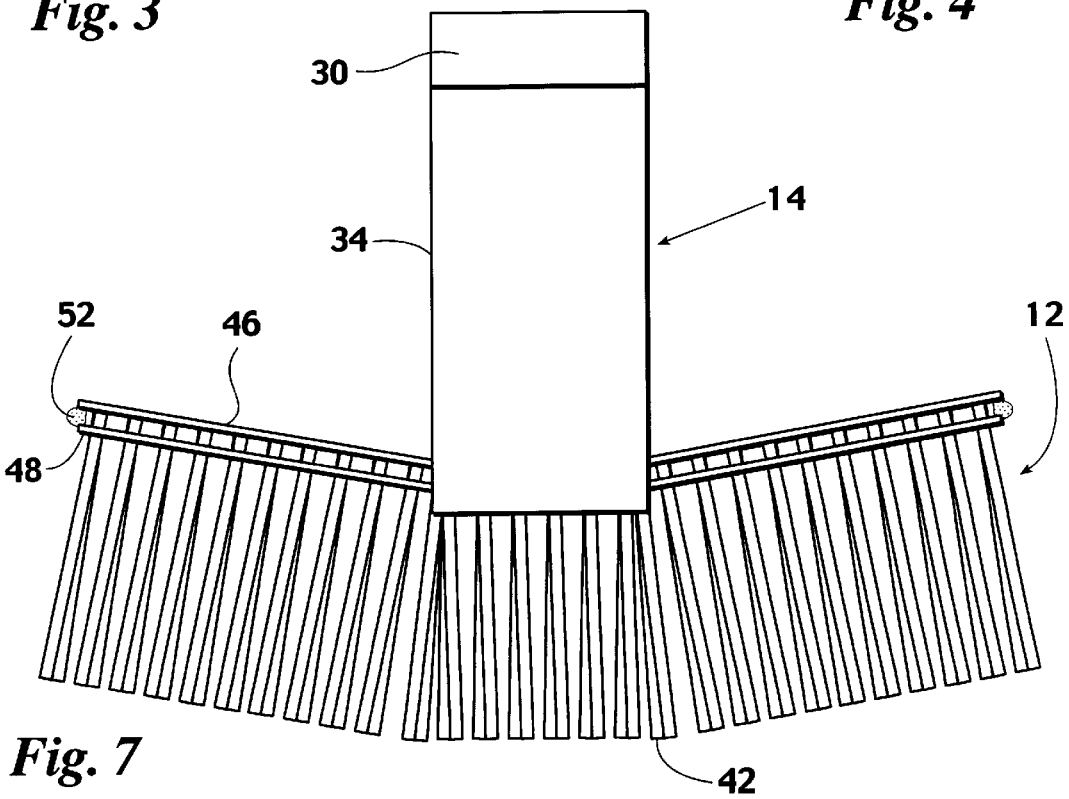
FIG. 7 is a viewing taken along view line 7—7 of FIG. 6.

Looking now at FIG. 7, the brush assembly 12 is actually bent so as to conform (to some degree) with the inner surface of the pipeline wall. This bend of the brush assembly 12 is accomplished by bending the plates 46 and 48 along vertical lines which are essentially coincident with the side edges 66 and 68 of the forward support member 32.

What is claimed:

1. In a cleaning device of the type for removing dirt, scale and extraneous material from the inner wall of a pipeline which comprises a body adapted to be moved longitudinally through the pipeline and a plurality of scraping elements mounted on the body for resiliently engaging the inner wall of the pipeline as the body is moved along the pipeline, at least one cup mounted on the body for sealably engaging the pipeline wall so that the body may be propelled through the pipeline by means of fluid pressure behind the cup, the improvement which comprises a polyurethane spring mounted between the body and each of the scraping elements for resiliently urging the scraping elements against the inner wall of the pipeline, the polyurethane spring comprising an elongated inner base member for attachment of the spring to the body, an outer side member disposed in spaced parallel relation with the inner base member and a plurality of cross members extending outwardly and rearwardly from the inner base member to and connecting with the outer side member, the cross members being essentially parallel to each other, the scraping elements being mounted on the outer side member and being resiliently urged against the inner wall of the pipeline by means of the polyurethane spring, the pressure of the spring against the outer side member being such as to tend to cause the outer side member to move rearwardly and inwardly, while the cross members cant in a rearward direction.

2. The improvement according to claim 1 wherein the scraping element is a wire brush formed from a plurality of wires whose outer ends are adapted to contact the wall of the pipeline to scrape dirt and other material from the inner wall of the pipeline, the inner ends of the wires being bend at an acute angle, the inner ends of the wire wires being connected to the outer side member of the polyurethane spring by means of first and second spaced metallic plates, the first metallic plate abutting against the outer side member and the second metallic plate being spaced from the first metallic plate, the bends of wires abutting against the surface of the first metallic plate and extending through holes in the second metallic plate, the adjacent edges of the plates being spot welded together.

3. The improvement according to claim 2 wherein the spaced metallic plates are shaped in the form of a parallelogram such that, when the cleaning device is passing through a pipeline, the rearmost trailing edge of a metallic plate supporting a given polyurethane spring will be disposed behind the forward edge of a metallic plate supporting an adjacent polyurethane spring so as to provide essentially 360 degrees of coverage of the inner wall of the pipeline for cleaning purposes.

4. The improvement according to claim 3 wherein each metallic plate is further bent along a pair of spaced lines parallel to the longitudinal axis of the body.

* * * * *